United States Patent [19]

Rasekhi

[11] 4,026,700

[45] May 31, 1977

[54] CHARGED PARTICLE MODULATOR DEVICE AND IMPROVED IMAGING METHODS FOR USE THEREOF

[75] Inventor: Houshang Rasekhi, Warrensville Heights, Ohio

[73] Assignee: Addressograph Multigraph Corporation, Cleveland, Ohio

[22] Filed: Feb. 24, 1975

[21] Appl. No.: 552,184

[52] U.S. Cl. ..... 96/1 R; 355/3 R; 96/1.4

[51] Int. Cl.[2] ..... G03G 13/14

[58] Field of Search ..... 96/1 R, 1.4; 355/3, 355/31, 17

[56] References Cited

UNITED STATES PATENTS

| | | | |
|---|---|---|---|
| 3,615,395 | 10/1971 | Yamaji | 96/1.4 |
| 3,625,604 | 12/1971 | Pressman | 355/31 |
| 3,645,614 | 2/1972 | McFarlane | 355/3 |
| 3,666,365 | 5/1972 | Fanaka | 355/17 |
| 3,680,954 | 8/1972 | Frank | 355/3 |
| 3,694,200 | 9/1972 | Pressman | 96/1 R |

*Primary Examiner*—John D. Welsh
*Attorney, Agent, or Firm*—Sol L. Goldstein

[57] ABSTRACT

A three-layered modulator, made up by sandwiching a photoconducting layer between a metal screen and an insulating layer, is applied separate and distinct fringing fields across the insulating layer corresponding to the image and non-image portions. The process calls for illuminating and applying a blanket electrostatic D.C. charge; simultaneously illuminating the modulator with a pattern of light and shadow and applying an oppositely poled D.C. charge; bringing the surface to an equi-potential level by applying an A.C. charge through a balanced A.C. corona or constant voltage A.C. scorotron; and in the final step, flood illuminating.

17 Claims, 5 Drawing Figures

STEP 3
(ALTERNATE)

CHARGED PARTICLE MODULATOR DEVICE AND IMPROVED IMAGING METHODS FOR USE THEREOF

BACKGROUND OF THE INVENTION

The present invention relates generally to the field of electrophotographic imaging techniques, and more particularly, is directed to the use of a foraminated device which is capable of having stored thereon a charge pattern corresponding to the light and dark areas of a graphic original. The device with the charge pattern thereon can then be used to selectively transmit and otherwise block the passage of charged particles directed towards its surface. The charged particles which are permitted to pass through the foraminated device are then collected on a dielectric material and then developed into a visible image. For the purpose of the description of the invention which follows, whenever the term "charged particles" is used, it shall mean both gas ion and toner particles. The term "blocked," whenever used herein, shall define the condition of a charged particle prevented from passing through the apertures in the device due to its being attracted to the surface of the conductor or otherwise repelled from the aperture and returned into the stream of particles directed against the device.

The described foraminated devices are capable of selectively passing or blocking charged particles so that they modulate the flow of a stream of particles projected against its surface. Such devices will be identified as modulators.

Electrophotographic reproduction techniques for making reproductions of graphic originals using photoconductive media are well known. Such processes call for applying a blanket electrostatic charge to a photoconductive layer, and then exposing it to a pattern of light and shadow created by directing electromagnetic radiation onto such graphic original and then projecting the resulting pattern by means of an optical system onto the light-sensitve photoconductive layer. In the light struck areas of the layer, the charges are conducted to ground, leaving behind the charge pattern corresponding to the dark or shadow areas of the graphic original. The images are rendered visible by the application of an electroscopic powder which is then fixed directly on the photoconductive layer of can be transferred and then fixed on a suitable receiving medium such as plain paper. This technique of electrophotographic reproduction has now been adapted for use with foraminated structures or modulators. The modulators of this invention are aperture devices capable of accepting an electrostatic charge and responding to a pattern of light and shadow to have recorded thereon a charge distribution system, which can then be utilized in ordinary room light without affecting the continued existence of the pattern on the surface thereof. In other words, the charge distribution system is, more or less, permanently contained on the modulator.

One system of using such modulators and the apparatus for carrying out such processes is fully described in U.S. Pat. No. 3,986,871 granted on Oct. 19, 1976 and SN 423,884 (abandoned) filed on Dec. 12, 1973, in the names of John D. Blades and Jerome E. Jackson.

To more fully apreciate and understand the modulator structures of this invention, it is necessary to discuss the imaging processes empolyed in the prior art. The modulators capable of retaining a charge distribution system (CDS) on its surface for long periods of time comprise a photoconductive layer, such as the well-known organic photoconductive material sandwiched between an insulating layer and a metal mesh. Such a three-layered structure has the unique properties of being able to record on the insulating surface a CDS which will endure in ordinary room light, and can be stored for long periods of time.

Such modulator construction permits the creation of a CDS on the insulating layer by first applying a blanket electrostatic charge of one polarity to the surface of the insulating layer and then applying a charge from an AC corona emission electrode, simultaneously projecting thereon a pattern of light and shadow. Alternatively, the charged surface is exposed to a pattern of light and the AC charge shadow and sequentially applied from a corona electrode. This first method results in zero potential in the light-struck areas of the modulator and distributes the charges in the dark areas so that they are at an equal potential level. When using the alternative procedure, the dark areas are at zero potential and distribute the charges in the light-struck areas.

The modulator is given a final flood illumination causing those charges in the photoconductive layer, which correspond to the dark areas of the graphic original, to be conducted to ground leaving a residual charge on the surface of the insulating layer and a corresponding charge bound at the interface between the insulating layer and the photoconductive layer. Such CDS results in electric fields across the apertures, corresponding to the pattern of light and shawdow generated by illuminating the graphic original, which are confined to the apertures. These are called fringing fields. These fields do not extend, to any appreciable extent, outside the thickness of the modulator. The electrical fields are the result of the dipole charge created across the insulating layer. When a charged particle or ion comes within the vicinity of an aperture, it encounters the fringing field. It will either be blocked or propelled through the aperture depending on the strength and direction of the field and the polarity of the charge particle.

It is characteristic of gas ions that are produced in air by a suitable high-voltage corona wire or a radioactive source to experience motion which is governed by the electric fields in the vicinity of the ion and by the number of collisions with the air molecules attributable to random thermal motion. The forces operating against the gas ions involved, in both of these situations, are electrical in character. The motion of the gas ions can be controlled by external fields produced by electrodes juxtaposed the modulator. The use of such electrodes, in combination with the modulator, is significant in creating an imaging system whereby charged particles can be projected against the modulator and collected on a suitable medium which becomes the reproduction of the graphic subject matter.

The electrical fields which are produced by such additional electrodes are set up so as to direct a uniform stream of charged particles through the modulator onto a collecting medium or collecting surface. Where the charged particles are toner particles, an image results directly on the collecting medium in conformance to the graphic subject matter and where the particles are gas ions, the collected charges can be developed by a suitable developing means. The electrical fields must be of sufficient strength to overcome the random thermal motion of the ions in the vicinity of the aperture and must be in a direction perpendicular to the ion collecting surface.

To achieve the aforedescribed control with respect to the charged particles, the modulator is placed close to and in a plane parallel to the plane of the charge particle collecting medium. Such a collecting medium is under the influence of a collecting electrode. Hence, to use a modulator with a CDS in an imaging system, the modulator is positioned between an emission electrode establishing a field between the modulator and the electrode, with the latter directing gas ions towards the metal layer of the modulator and a collection electrode positioned on the opposite side of the modulator, facing the insulating surface, which similarly produces a field whose direction is perpendicular to the collecting surface. Associated with the collection electrode is a collecting medium such as a sheet or web of dielectric material in intimate contact with the collecting electrode on which is received the projected charged particles or gas ions which are blocked or transmitted through the modulator.

In the light struck areas, charges are induced in the conductive layer and proceed through the photoconductive layer which is in a conductive state and permits the charge carriers to move through to the interface at the insulating layer.

In the dark areas of the photoconductor, the charges remain trapped. However, the oppositely poled DC corona renders the charges on the insulating surface the same polarity as at the interface.

The modulators described in the aforementioned U.S. patent and abandoned application and successfully be utilized with the processes described therein and provide all of the advantages and improvements over prior art modulator structures and systems. However, the techniques and systems known heretofore for utilizing such three-layered modulators have not been without disadvantages. The deficiencies from which such known procedures suffer relate to the degree of modulation afforded by the system to the charged particles or gas ions presented to the surface and secondly, the period of time necessary to create the charge distribution system (CDS) on the modulator.

The inventions described in U.S. Pat. No. 3,986,871 granted on Oct. 19, 1976 and Ser. No. 423,884 (abandoned). provide for a modulator having a substantially long memory, that is, it is capable of sustaining the CDS on its surface for extended periods of time, even in room light.

The CDS sets up fringing electrical fields in the modulator openings. Such a modulator, in which the photoconductor is sandwiched between the insulating layer and the metal screen, is capable of either blocking the passage of charged particles directed against its surface or permitting the particles to pass through certain areas. The passage of the charged particles through certain openings of the modulators occurs as a function of the natural movement (thermal motion) of the particle within the modulator assisted by the external field forces set by the corona and collecting electrodes. It is also possible to provide a CDS which produces propelling fields or fringing fields in portions of the modulator which exert the necessary force on particles coming within the apertures of the modulator, projecting them through the apertures. In the remaining portions of the modulator which have not been applied a fringing field across the aperture, the charged particles tend to be attracted to the conductive layer, but a certain number of particles move through the aperture by virtue of the external electrodes and their normal movement within the aperture.

Hence, it will be appreciated that the imaging properties of such a modulator can be treated with a CDS so that it either blocks the passage of ions or provides the necessary fields for propelling them through the apertures; but in either case the uncharged portions permit some of the ions to pass through. Understandably, the situation where the ions will form the image, the process is very slow, without a propelling force, in terms of the quantity of charges that can be collected through the modulator as a function of time. In the other case, where there is a field created across the modulator, it speeds up the process, but some of the ions pass through the uncharged portions so that ions go through where ions are not intended to go through.

SUMMARY OF THE INVENTION

The disadvantages of the systems known heretofore have been overcome by carrying out novel processing steps in order to produce the CDS which substantially decreases the processing time and greatly improves the image producing function of said modulator. It has been found that the success of this improved process requires the photoconductive layer to be bichargeable in order to take advantage of the improved processing steps.

The first step calls for the application of a direct current charge of a first polarity emitted from a corona electrode directed onto the insulating surface. Concurrent with the application of such a DC charge, the modulator is applied electromagnetic radiation from an illuminating source. The action of illumination simultaneous with the application of charges on the insulator cause the formation of oppositely poled charges to be bound at the interface between the insulating layer and the photoconductive layer. This occurs by virtue of the creation of photogenerated charge carriers within the photoconductive layer. Such photogenerated carriers at the interface of the photoconductor and insulator are the result of both the presence of the electric field as well as the electromagnetic radiation. Like charges are repelled from one another so that those charges in the photoconductive layer having the same polarity as the charge on the surface of the insulating layer are repelled and are forced through the photoconductor and into the conductive layer leaving oppositely poled charges bound at the interface between the insulator and the photoconductor.

In the next step, a corona electrode connected to a DC source applies charges opposite in polarity to the charges in step 1, onto the insulating surface simultaneous with a light pattern. This produces areas which are dark and those which are light exposed. The second DC corona charging step reverses the polarity of the charges at the surface of the insulating layer. In the dark areas of the photoconductive layer, the charges at the interface of the photoconductive layer and insulating layer are trapped since the photoconductor is in a non-conductive state. The charges on the insulating surface are now the same polarity as the charges at interface in the dark areas. The conductive layer being connected to ground potential of the DC source provides charges which are oppositely poled to the charges on the insulating surface at the interface between the conductive layer and the photoconductor. The magnitude of the charges at the conductor - photoconductor interfaces is equal to the charges trapped at the photoconductor-insulator interface and on the insulating surface.

In the light struck areas the polarities of charges at the insulating surface and at the photoconductor - insulator interface are reversed from what was imparted to the layers in step one. The CDS is now comprised of charges having the same polarity on this insulating surface as are bound in the dark areas at the interface and oppositely poled charges on the insulating surface as are in those areas at the interface which have been light struck.

In the third step of the process, which is carried out in the dark, a balanced output AC corona sweeps across the entire insulating surface for the purpose of redistributing the charges making all areas on the surface at the same potential.

As a final fourth step, the modulator is given an overall exposure by directing electromagnetic radiation from a suitable source onto the transparent insulator. This produces oppositely directed dipoles in each zone.

It is the general object of this invention to provide an improved imaging process for rapidly making high contrast reproductions of graphic originals using a modulator having separate and co-existing electrical fields associated therewith for controlling the passage of charged particles through the image and non-image areas.

It is an object of this invention to provide an improved imaging process for rapidly making high contrast reproductions of graphic originals through the use of a modulator having applied across various apertures therein separate electrical fields which have been photoelectrically produced and which provide a high degree of flexibility as to the type of image which may be reproduced from either a positive or negative form of a graphic original by reversing the polarity of the ion source.

It is another object of this invention to provide an improved modulator-controlled imaging system for making high contrast reproductions of graphic subject matter capable of controlling the passage therethrough of charged particles operating in conjunction with an electrode system and which provides a high degree of flexibility as to the type of image which may be produced from either positive or negative type graphic originals by reversing the polarities of the charged particles.

It is a specific object of this invention to provide an improved imaging system for making high contrast reproductions of a graphic original in which an ion modulator is used with an ion projecting electrode system capable of projecting ions through the modulator at sufficiently high rate to be deposited on a collecting medium to produce high density images in rapid succession.

It is a further specific object of this invention to provide an improved imaging system for making high contrast reproductions of graphic originals using a modulator containing separate and coexisting electric fields associated with the apertures therein, which electrical fields have been photoelectrically produced, so that charged particles are selectively transmitted through the modulator at a rapid rate to produce high density images in relatively short periods of time.

It is another object of this invention to provide an improved reproduction apparatus capable of making high contrast multiple reproductions of a graphic original utilizing a modulator having imposed across its various apertures separate-coexisting electric fields corresponding to the image and non-image areas so as to transmit charged particles at a rapid rate through certain of its apertures to produce high density images and to block charged particles in other portions corresponding to the non-image areas to produce a reproduction of high contrast on a suitable charge collecting medium.

It is the still further specific object of this invention to provide an improved reproduction apparatus capable of making high quality multiple reproductions of a graphic original utilizing a multiple-layered modulator having imposed across its apertures separate electrical fields which have been photoelectrically produced thereon permitting the reuse of said modulator to produce numerous reproductions of one graphic original or to rapidly reimage said modulator to create new charged particle-discriminating fields.

It is another object of this invention to provide an improved modulator in which the photoconductive layer is capable of sustaining oppositely directed separate electrical fields under controlled conditions.

Other objects and features of this invention, particularly the parameters for each of the processing steps as they may be applied in the reproduction field of art, will become apparent to those skilled in this art from the reading of the following detailed descriptions.

DETAILED DESCRIPTION OF THE INVENTION

Figure 1:
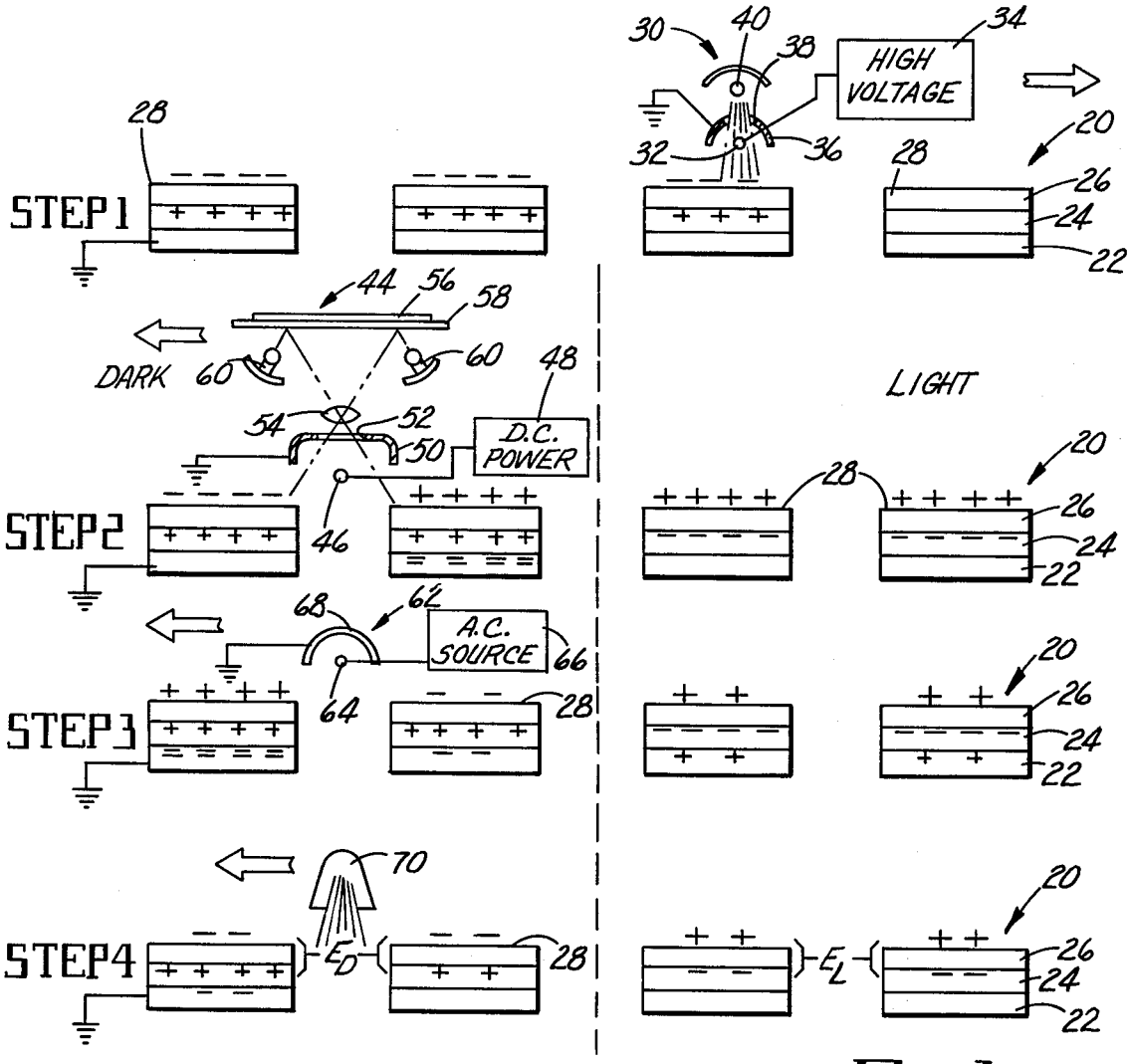
FIG. 1 is a schematic representation illustrating the steps necessary to create the electrical fields on the modulator.

Referring to FIG. 1, there is depicted four steps that comprise the novel process for producing a CDS on a modulator bearing the general identification numeral 20. The modulator 20 is made up of three separate and distinct layers, the first being a conductive layer 22 which is a wire mesh screen formed of a conductive material such as stainless steel, copper, brass, aluminum or steel wire. The use of metals readily satisfies the conductivity requirements for the base layer 22. Other conductive or semi-conductive materials may be used provided the relaxation time is less than the time duration of the processing steps.

Superimposed on the conductive layer 22 is the photoconductive layer 24 which must posses certain bichargeable characteristics in order that one realize the benefits and advantages available from the use of the novel process.

The complimentary property to bichargeability is the rectifying property of the photoconductor. Rectification means that the photoconductor has charge acceptance in one direction (polarity) only, whereas the non-rectifying photoconductor has charge acceptance in either direction. We are concerned in this invention with relatively non-rectifying photoconductors.

A wide range of photoconductive materials may be utilized to form the layer 24 to meet the bichargeable requirements in practicing the invention. Selenium, as a representative of the class of elemental photoconductors, works well. Inorganic photoconductors such as metal ions containing crystalline compounds such as zinc oxide are also suitable.

A wide range of organic photoconductive materials may be used which are polymeric and therefore film forming in themselves, or which are compounds that be dispersed in a film forming resin binder.

Typical of the organic photoconductive polymers are the following compounds:

polyvinyl carbazole (U.S. Pat. No. 3,037,861)
polyvinyl benzocarbazole (U.S. Pat. No. 3,751,246)
polyvinyl iodo benzocarbazole (U.S. Pat. No. 3,764,316)
poly acryloyl carbazole
poly acryloyl benzocarbazole
poly acryloyl iodo benzocarbazole
N-substituted polyacrylic acid aminers (U.S. Pat. No. 3,037,940)

Representative of the organic photoconductors of the monomeric type, the following can be used:

phenyl oxazolone (U.S. Pat. No. 3,257,203)
triaryl alkanes (U.S. Pat. No. 3,542,544)
triaryl amines (U.S. Pat. No. 3,542,548)
phenyl-pyrazoline (U.S. Pat. No. 3,180,729)
alknyl amino phenyl substituted amino thiodiazoles (U.S. Pat. No. 3,161,505)
diaryl amines and triaryl amines (U.S. Pat. No. 3,141,770)

Other photoconductive materials not specifically referred to herein are well known in the art. The property of bichargeability, if it is not inherent in the material, can be produced through the use of various chemical sensitizers and dyers.

The preferred photoconductors are the polyvinyl carbazoles, polyvinyl benzo carbazole, polyvinyl monoiodo benzo carbazoles, and selenium.

As is well known in this art, the organic photoconductors are combined with sensitizers which significantly increase the photo response of the photoconductor. Sensitization of the organic photoconductors may be accomplished through the use of dyes. The use of $\pi$-acids is more widely accepted as sensitizers for the photoconductive materials. The photoresponse of these materials is believed to reside in the donor-photoconductive material forming a complex with the $\pi$-acid acceptor.

The preferred acceptors to be used with the aforementioned preferred photoconductors are the fluorenone compounds such as 2,4,7, trinitrofluorenone; dicyano methylene substituted fluorenones described in U.S. Pat. No. 3,752,668 to Evan S. Baltazzi; the bianthrones described in U.S. Pat. No. 3,615,411 to William J. Hessel; and oxazalone and butenolide derivatives of fluorenone, described in U.S. Pat. No. 3,556,785 to Evan S. Baltazzi. It has been found the type of acceptor employed can influence the bichargeability properties of the photoconductive materials.

Continuing with the description of the modulator construction, layer 24 can range in thickness from 3 microns to 50 microns, depending on the nature of the photoconductive material and the screen mesh size. The useful thickness, when using organic photoconductors, may range from 3 to 10 microns, selenium 5–40 microns, and zinc oxide 10–50 microns. It should be pointed out that the thickness of the layer 24 is not critical. However, it is important that it is applied with a sufficient degree of consistency and uniformity so as to completely and uniformly cover the conductive mesh 22.

When using selenium as the photoconductor, it will appreciated that the ability of the modulator to sustain both a positive and negative charge depends on the junction between the selenium and the metal. Examples of such junctions are screens made of copper, aluminum of stainless steel.

The third and final layer of the modulator 20 is the insulating layer 26. This layer is required to have a relaxation time substantially greater than the time required to utilize the modulator in a duplicating process. A resistivity value greater than $10^{15}$ ohm-centimeter is required for this layer in order that it possess the proper relaxation time constant. Suitable insulating materials which may be used for the layer 26 are polystyrene, polyester resins, polypropelene resins, polycarbonate resins, acrylic resins, vinyl resins, epoxy resins, polyethylene terephthalate and polyfluoride resins. The resins may be applied from a solvent solution by spraying the screen structure or otherwise coating the structure with a solution in order to provide a uniform thickness of the insulating material onto the photoconductive layer 24. The layer 26 must be firmly bonded and is required to make complete contact with the photoconductive surface in order to operate effectively. The general procedures for fabricating such modulators will be described in greater detail hereinafter.

With the modulator 20 formed of the layers 22, 24, and 26, the uppermost layer 26 has an exposed surface 28 to which is applied a blanket electrostatic charge from a high voltage DC source 34 by spraying ions emitted from a charging assembly 30. The charging assembly is comprised of a fine wire electrode 32 connected to the high voltage DC source 34 capable of supplying voltages, for example, in the range of 3,000 to 10,000 volts. The wire electrode 32 is surrounded by a conductive shield 36 connected to ground and is equipped with a longitudinally extending aperture 38 so as to provide a continuous window through which can pass electromagnetic radiation from the radiation source 40. The radiation is directed onto the insulating layer surface 28 simultaneous with the emission of the gas ions from the source 34. The high voltage source 34 can be DC.

As shown in step 1 of FIG. 1, the charging assembly 30 is adapted to traverse the entire 28 of the insulator 26 moving in the direction of the arrow so as to apply a blanket electrostatic charge thereto.

The exposure to electromagnetic radiation simultaneous with the emission of the DC charge imparts a uniform electrostatic charge to the surface 28 and results in the creation of charge carriers within the layer 24 which are photogenerated carriers by virtue of the flood exposure to electromagnetic radiation. In step 1 of FIG. 1, the wire electrode 32 is connected to the negative terminal of the high voltage source 34 depositing an array of negative charges on the surface 28 and at the same time inducing an array of positive charges in the conductive layer 22. Within the photoconductive layer 24 there are photogenerated charge carriers or charge complexes, which are positive and negative. The negative component of the charge complexes is forced through the photoconductor in the direction of the conductive base to be neutralized by the induced positive charges. At the interface between the photoconductive layer and the insulating layer there is left an array of positive charges. It will be appreciated that the movement of the negative charge component of the complexes moves under the influence of the electrical field being imposed by the DC corona. At the end of step 1, the modulator has an array of negative charges on the surface 28 and an array of positive charges bound at the interface between the layers 24 and 26.

In the second step, as depicted in FIG. 1, the modulator 20 is exposed to an imaging system assembly 44. The imaging assembly 44 comprises a corona wire 46 connected to a high voltage DC power supply 48. Surrounding the wire electrode 46 is a conductive shield 50 having a window or aperture 52 which extends the full length of the shield coinciding with the working length of the modulator 20. In optical alignment with the aperture 52 is a lens 54 which forms an optical path for the graphic subject matter appearing on the graphic original 56. The original 56 is placed face down on a transparent platen 58, the underside of which is illuminated by a pair of radiation sources 60 thereby forming a pattern of light and shadow which is projected by the lens to the surface 28 through the aperture 52.

As the imaging assembly 44 traverses the modulator 20 in the direction of the arrow, the DC power source causes positively charged gas ions to deposit on the surface 28 replacing the negative charges on the insulating layer. For purposes of illustration, the diagrams are identified as LIGHT and DARK indicating the condition of being exposed or not exposed, respectively. The areas in photoconductive layer 24 which are light struck and charged result in an array of negative charges at the interface between the layers 24 and 26. This reversal of charge polarity in the photoconductive layer occurs because oppositly poled charges or negative charges are induced in the conductive layer 22 and positive charges from step 1 are forced through the photoconductor and neutralized by the negative charges in the metal. The negative component of the photogenerated charge complexes produced in the photoconductive layer remain. Giving consideration to those portions of the modulator which are not exposed to radiation or correspond to the dark portions of the graphic origianl, we see that an array of positive charges from the positive ions generated from the assembly 44 are deposited on the surface 28. Since the photoconductive layer 24 is in a non-conducting state, the corresponding negative charges which are induced remain in the conductive layer so that at the end of step 2 the dark portions of the modulator have positive charges on the surface 28, a corresponding array of positive charges at the interface of layers 24 and 26, and a balancing number of negative charges at the interface of layers 22 and 24.

In the third step, the modulator 20 is sprayed with charges from an electrode 62 made up of a corona wire 64 connected to a balanced AC source 66. The corona wire 64 is partially surrounded by a conductive shield 68 which is connected to ground and traverses the surface 28 of the modulator 20 in the direction of the arrow as shown in FIG. 1. Step 3 takes place under conditions in which the modulator is protected from electromagnetic radiation. The purpose of sweeping the surface 28 with an AC corona is to bring the insulating surface 28 to a net zero potential. This means that the AC corona will render both the dark and light struck zones to the same potential level. The electrode 62 has the effect of short circuiting the layers 26 and 22 to cause the charges to flow from the insulating layer into the conductive layer 22. In the light struck areas positive charges flow into the conductive layer so that the field across the insulating layer and conductive layer tend to be equal and opposite. Another way of describing the effect of the AC corona is that it redistributes the charges such that an equipotential surface is created near the insulating layer. In the light struck area, the photoconductive layer 24 is in a conductive state due to the bichargeable characteristics of the photoconductor, and the negative charges are not conducted away but remain bound up between the layers 24 and 26.

In the dark zones, the AC cornoa will displace the charges from the insulating surface 28 to the conductive layer 22 thereby neutralizing some of the negative charges that are held at the interface between the conductive layer and the photocondutive layer as shown in step 2. The photoconductive layer 24, in the dark zones, has an array of positive charges bound at the interface between the layers 26 and 24 thereby causing the induction of negative charges on the surface 28, and the retention of a capacitance dependent negative charge at the interface of the conductor 22 and the photoconductor 24. The result is that in dark zones the field across the insulating layer and across the conductive layer are of the same polarity with oppositely poled charges created in the photoconductor. As will be explained in greater detail hereinafter a voltage controlled AC corona in step 3 imparts to the process a wide range of capabilities as far as controlling the quality of the final reproduction. The system allows varying the speed of making a reproduction which effects contrast value of the final copy. Greater speeds will give less contrast value and slower speeds provide greater contrast.

To summarize the condition of the modulator at the end of step 3, it has on the surface 28 positive charges in the light struck zones and negative charges in the dark zones, and oppositely poled charges in the layer 24 but the same polarity of charges in the layer 22.

In the fourth and final step, the modulator 28 is given a blanket exposure to an electromagnetic radiation from the source 70. In the dark zones, this causes the photoconductor to become conductive causing the positive charges trapped therein to leak off to the conductive layer 22 neutralizing the oppositely poled charges therein and reducing the field across the conductive layer to zero value and producing a field due to the dipole created by the charges on the surface 28 and those bound at the interface between the layers 24 and 26 resulting in a field across the thickness of the insulating layer. In the light zones, the photoconductive layer becomes conductive in response to the blanket exposure causing the negative charges to be conducted into the layer 22 neutralizing the oppositely poled charges in that area and thereby producing an electrical field across the insulating layer. This field is opposite in direction to the field imposed across the insulating layer in the dark zones.

The aforedescribed process results in the modulator 20 imparted with a CDS which corresponds to the generated pattern of light and shadow projected by the imaging assembly 44. The nature of the CDS is such that separate and coexisting dipole fields are established across the insulating layer in the light and dark zones which are opposite in direction and may or may not differ with respect to their strength.

Figure 2:
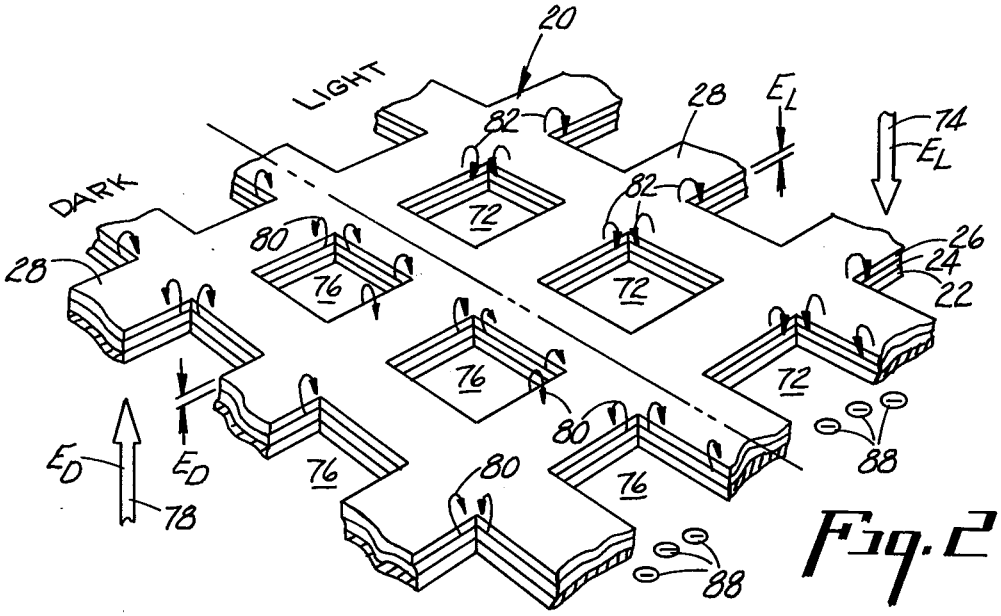
FIG. 2 is a perspective view of the modulator showing schematically the direction and location of the electrical fields produced on the modulator.

Referring to FIG. 2, there is shown the modulator 20 which has a CDS with the respective dipole fields across the insulating layer 26. In the light struck zones, the field across the insulator $E_L$ is shown as emanating from the positive charges moving in the direction of the negative charges bound at the interface. In the dark zones, the field is across the insulating layer 26 emanating from the interface between the insulator and the photoconductor and terminating at the insulator surface 28. The field direction of $E_L$ occurring at the apertures 72 in the light zones is directed downwardly as shown by the arrow 74. In the apertures 76 in the dark zones, the field $E_D$ across the insulating layer has an upward direction as shown by the arrow 78.

In the practice of this invention, it is preferable to project the charged particles in the direction of the conductive layer 22 so that they cannot readily collect on the insulating surface 28 and thereby interfere with the fields created in the insulating layer 26. In the circumstance that the ions emitted from an emission electrode should be directed toward the surface 28 of the modulator 20, it will result in the accumulation of further charges on the surface of the insulating layer which would only tend to obliterate the existing CDS so that the modulator thereafter is incapable of operating to selectively pass through or block projected ions.

The establishment of the fields $E_D$ and $E_L$ across the layer 28 makes it possible for the modulator 20 to block charges particles or gas ions as they are presented to the apertures 72 and 76 or permit them to pass through. The modulator in FIG. 2 results from a negatively poled precharge in step 1 and has therefore resulted in negative charges on the surface 28 in the dark zone and positively poled charges in the light zones. The direction of the field lines 80 and 82 are shown in a conventional manner, from positive to negative charge. The field lines 80 and 82 extend into their respective apertures 76 and 72 thereby exerting a particular effect on the charged particles entering the apertures.

Referring again to FIG. 2, a series of gas ions or charged particles 80 are shown moving in the direction of the layer 22 approaching the apertures 72 in the light zones and 76 in the dark zones. As the negatively charged particles 88 move counter-current to the direction of the arrow 74 and the positive field 82, they will be propelled through the aperture 72 in the light zones. In the circumstance that the gas ions would be positively poled, they would tend to be propelled away from the aperture in the direction of the conductive layer thereby being blocked from passing through.

As to the gas ions 88 which are directed to the aperture 76 in the dark zones, it will be observed that they are moving in the direction of the arrow 78, that is, cocurrent and will be repelled by the field $E_D$ and be blocked.

Hence, it will be seen that the projection of charged particles from a corona emission electrode directed against the metal layer 22 of the modulator 20 will pass through apertures 72 in the light zones and be blocked by the apertures 76 in the dark zone. As described hereinabove, by means of a suitable collection electrode system, it is possible to provide a dielectric paper on which the particles passing through the modulator will be collected, thereafter to be developed into a material image. In the description of the operation of the modulator in FIG. 2, the ions transmitted by the apertures 72 will correspond to light reflective or light transmitted surfaces of the graphic original. In other words, if the graphic original is a positive, then the reproduction produced by the CDS in FIG. 2 would be a reversal image. If the graphic original is a silver transparency or negative, then the portions which transmit light correspond to the image and a positive will be produced.

It will readily be appreciated that by merely reversing the polarity of the projected charges from the ion emission source, one can reverse the nature of the image produced on the dielectric paper.

Figure 3:
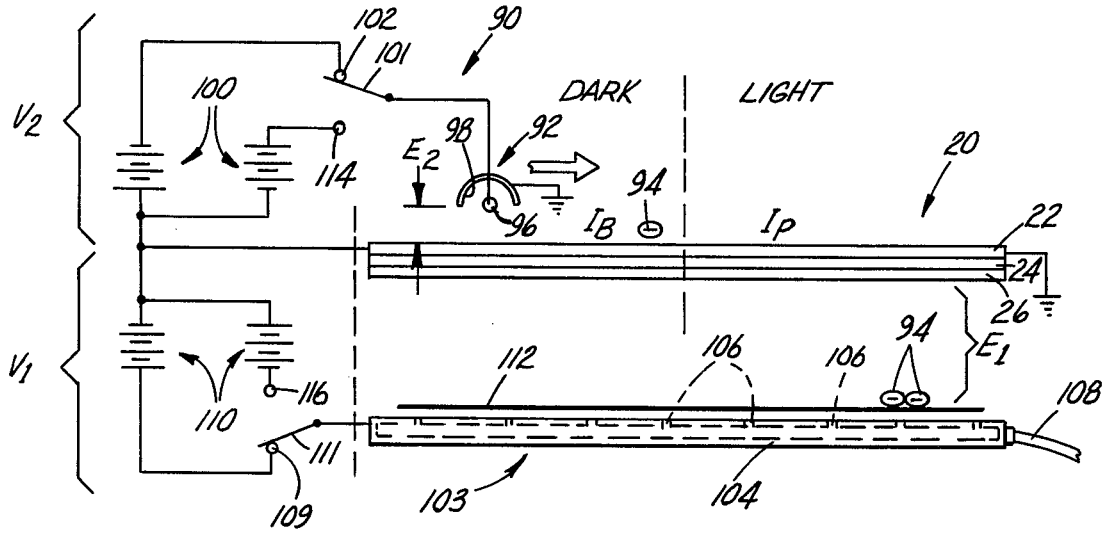
FIG. 3 is a schematic representation of the system of electrodes and their arrangement for generating and collecting the charged particles through the modulator.

In order to use the modulator with the CDS thereon as an imaging device by the virtue of its capability of discriminating charged particles directed against and entering its apertures, it is necessary to place it in an environment which is likened to a grid system in a triode vacuum tube. Referring now to FIG. 3, there is shown an ion projection assembly 90 comprised of an emission electrode 92 which projects ions toward the conductive layer 22 of the modulator 20. The electrode 92 comprises a corona wire 96 surrounded by a conductive shield 98 which is connected to ground. The wire 96 is connected to the negative terminal of a potential source 100 by operating the switch 101 to the contact 102, the positive terminal being connected to the conductive layer 22. The emission electrode 92 creates a field $E_2$ between the corona wire 96 and the surface of the conductive layer 22, in which lines of force emanate from the conductive layer 22 and are directed towards the corona wire 96.

Certain of the impinging ions will pass through the aperture in the light zone and come under the influence of a collecting field $E_1$ produced by the collecting electrode 103. The collecting electrode 103 consists of a hollow plate member 104 which is equipped with openings 106 in one surface thereof to permit the influx of air to the interior of the plate and having an outlet connection 108 which leads to a vacuum pump (not shown) for exhausting air from the electrode 103 so as to cause a pressure differential between the atmosphere and the surface thereof. The electrode 103 is connected to the positive terminal 109 of a potential source 110 through the operation of the switch 111. The electrode is disposed in the projection assembly 90 so that it lies in a plane parallel to the plane of the modulator 20 and facing the insulating layer 26 thereof.

The receiving medium 112, which may be a sheet or web of suitable material, such as dielectric paper, plastic film, or cloth, is placed on the surface of the plate 104 in contact with and covering the openings 106 creating a pressure differential at the surfaces of the plate causing the paper 112 to be brought into pressure contact with the electrode 103. As the negative ions 94 pass through the modulator 20 in the light areas, they come under the influence of the collecting field $E_1$ which can be in the range of 500 to 12,000 v/cm which causes them to be propelled and directed toward the collecting electrode 103 and to be attracted to the paper 112 in a pattern which conforms to the CDS of the modulator 20 and corresponding to the pattern of the graphic original to be reproduced. Upon completion of the collection of the ions on the paper 112, it is removed from the electrode assembly and the visible image is developed by conventional developing techniques using electroscopic powder.

The potential applied to the emission electrode 92 is in the range of 3,000 to 12,000 volts and the range for the field strength $E_2$ is in the range of 1,000 to 3,000 volts per centimeter. The projection assembly as described in FIG. 3, wherein the surface 28 carries a negative charge in the dark zone and a positive charge in the light zones when subjected to an emission electrode supplied from the negative terminal of the power supply 100 will be blocked from passage through the openings 72 (FIG.2) in the light zones but permitted to pass through the apertures 76 (FIG. 2) in the dark zones. This will result in a developable material image corresponding to the patterns appearing in the light zones of the modulator 20.

To reverse the imaging results, it is only necessary to operate switch 101 to contact 114 thereby connecting the electrode 96 to the positive terminal of the power supply 100. The switch 111 should be moved to the negative terminal 116 to connect electrode 103 to the negative side of the power supply 110. The foregoing changes in the switch setting will now produce a developable charge pattern corresponding to the dark zones of the modulator. This is for the reason that the positive ions will now be permitted to pass through the dark zones for the reason that they move cocurrent with the direction of the field $E_D$ as shown by the arrow 78 (FIG. 2).

To further illustrate the operation of this invention, a typical modulator may be formed or constructed starting with, for example, a 200 mesh screen, as the base support. The screen is formed of a woven metal, such as stainless steel. The wire diameter is 0.05 millimeters and the 200 mesh designation defines a structure whose average apertures are 0.07 millimeters in the widest dimension.

The metal screen is thoroughly cleaned before it is applied to a photoconductive layer. As described hereinabove, a wide range of photoconductive materials may be used to form a photoconductive layer having the proper relaxation constant. A typical modulator may be formulated by dissolving 10 grams of a donor material such a poly (7-vinyl-ido-7H benzo [c] carbazole) as a solvent mixture comprising 70 grams of tetrahydrofuran and 110 grams of methylene chloride to which was added 5.6 grams of the sensitizer or $\pi$-acid 2-(p-t-butylphenyl)-4-2 (2,4,7-trinitrofluorenylidene)-2-5 oxazalone. The solvent solution of sensitizer and photoconductor is sprayed onto the metal screen to a uniform thickness and then force-air dried in an oven to evaporate the excess solvent to a final thickness of about 10 microns.

The third layer to be formed is the insulating layer which is a polymeric material such as polystyrene. A solution is made up of polystyrene consisting of 5% by weight solids available from Dow Chemical Corporation sold under the product designation PS-1 or PS-3. The solvent system includes four parts butyl acetate, four parts methyl cellosolve acetate, and two parts methyl ethyl ketone. The resulting solution is sprayed onto the screen in sufficient quantities to provide an insulating layer, when dry, of about 4 microns in thickness.

The modulator as described herein has suitable bichargeable properties under a positive sensitizing charge and under a negative sensitizing charge condition.

As stated earlier in the description of this invention, one of the advantages of the dual fields established on the modulator and identified in FIG. 2 as $E_L$ and $E_D$ is the production of high contrast images and the greatly increased speed in producing these fields on the modulator. The surprising and unique advantages are best illustrated by having reference to the curve shown in FIG. 4. This curve is generated by plotting the modulator insulator voltage $V_1$ (FIG. 3) along the abscissa and thecorresponding transmission current, as compared to the incident current in terms of percent along the ordinate. It will be appreciated that the optical density is defined as the $\log_{10}$ of the ratio of the currents in the dark areas to the currents in the light areas, provided the optical density changes linearly with the $\log_{10}$ of charge deposited on the copy sheet. The voltage referred to represents the potential difference between the metal layer and the voltage on the surface of the insulator as measured by a non-contact electrostatic voltmeter. The percent current transmission value plotted along the ordinate represents the current through the modulator in relation to the total current or incident current applied to the modulator. The term current refers to the number of charged particles which are either collected per second on the collection electrode or the total number of charged particles directed to the surface of the modulator which represents the incident current.

The conditions under which this curve was obtained involved a three-layer screen construction such as described herein which the modulator was applied negative electrostatic charge in the intial step so as to produce a negatively poled voltage in the dark zones and positively poled potential in the light struck zones. Further, the polarity of the charged particles projected toward the modulator were negative so that such charged particles tended to be blocked in the dark zones and propelled or transmitted through the light struck zones.

Figure 4:
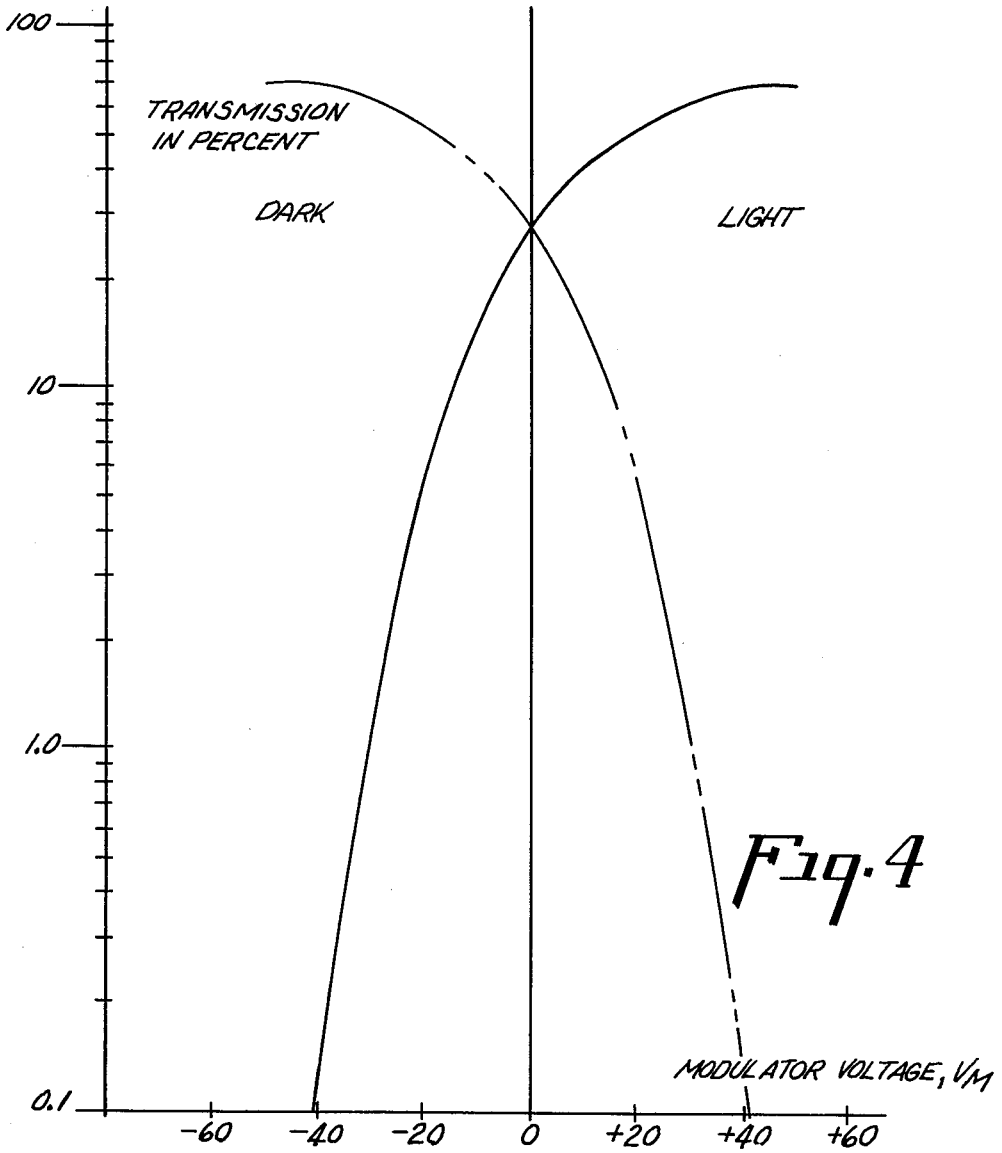
FIG. 4 is a plot of the log of percent current transmission through the modulator vs. voltage of the separate fields.

In the circumstance the process is carried out where the initial charged in the first step is positively poled and negatively poled charges are applied in the second step, the curve in FIG. 4 would take the dotted line form as shown. When projecting negative charges, they would be propelled in the dark zones and blocked in the light exposed zones.

It is appropriate at this point in the discussion to describe the operation of prior art moudlators prepared by the known processes which produced only a blocking field or a propelling field. Accordingly, the curve may be used to describe the operation of a modulator in which there would be only one fringing field in, for example, the light-transmitting zone. In the preparation of such a modulator, the voltage on the surface of the insulator in the blocking zone was +20 volts and the voltage in the light-struck area was at ground potential and therefore would be determined by following the zero potential line to where it intersects the curve and then pick up the corresponding value from the abscissa. At 0 volts in the light-struck areas, the transmission would be 28% and at +20 volts the transmission would be 55%. The optical density of the final copy, assuming a linear relationship between optical density and the log value of the collected charges, will be: $\log_{10}$ (55/28) =0.29.

The imaging properties depicted by this curve with respect to such a prior art modulator tells us that the voltage difference ($\Delta$) between the blocking and propelling zones of the surface of the modulator is about 20 volts. Further, some passage of current occurs in the blocking zones and is collected on the charge collecting surface. In the light-struck zones, the transmitted current is about 28% which represents the image portions of the reproduction. It will be appreciated the greater the value of current transmitted through the propelling zones, in this case the light struck zones, the greater will be the density of the image. It should also be noted that it is a rate function and that the greatest number of charged particles that can be collected on the collecting media in the shortest possible time will give a highly dense image. This will be recognized as equivalent to a high transmission current. Accordingly, the higher the transmission current, the shorter will be the period of time necessary to produce a dense image.

In the ideal situation, there should be no transmission in the dark zones, that is, no transmission of charged particles thereby giving the greatest degree of contrast between the image and non-image portions. However, as is shown, there must occur some transmission of charged particles or current through the blocked zones. As will be understood in the operation of such prior art modulators, it is possible to reverse the zone, that is, achieve transmission through the drak zones, represented by the curve on the left side of the zero potential line and a blocking in the light-struck zones represented by the curve on the right of the zero line. This is achieved by simply projecting positively poled charged particles instead of the negatively charged particles. In order that the curve in FIG. 4 be applicable to such a set of conditions, the polarity of the modulator voltages shown along the abscissa are reversed so that those which are shown as negatively poled in the dark zones are now positive and the light-struck zones should be considered as a negative sign. Hence, in the zero potential the zones which are now blocking transmission would be 28%. In the transmission or repelling zone which has a −20 volt potential, the transmission would be 45%. Under these circumstances, it will be seen that while a differential image can be obtained, the contrast would be somewhat poor.

In summarizing the results obtained from practicing the piror art processes in which the fringing fields in the modulator are in one zones, it is possible to obtain low current transmission in the blocking zones with some current transmission in the light-struck zones at a given Δ value or to obtain higher transmission of current at the expense of substantial increases in the background giving less desirable contrast in the final reproduction.

Turning now to the process of the instant invention and referring again to FIG. 4, we have the case of a −20 volts (blocking) recorded in the dark zones and a +20 volts (transmission) in the light zones which represent a Δ of 40 volts across the surface. Such a large spread of Δ will generate significantly higher contrast as will be readily appreciated from studying the plot in FIG. 4. At −20 volts, the transmission in the dark zones is 4.5%. In the positively charged zone, the transmission corresponding to the +20 volts is 55%. Hence, it is immediately apparent that such a process will produce reproductions which have high contrast by virtue of the high transmission in the light-struck areas and the relatively low amount of transmission in the dark zones having a relative optical density of 1.08 units. Further, it should be noted that the process produces a modulator having an Δ of 40 volts as compared to a Δ of 20 volts in the prior art system.

An important and unique feature of the process of this invention is the ability to control and vary the contrast as well as the speed of projecting ions onto the collection medium. Up to this point in the discussion the third step of the process, wherein the blanket charge from a balanced AC corona is applied to the insulating layer produced a net zero potential.

Figure 5:
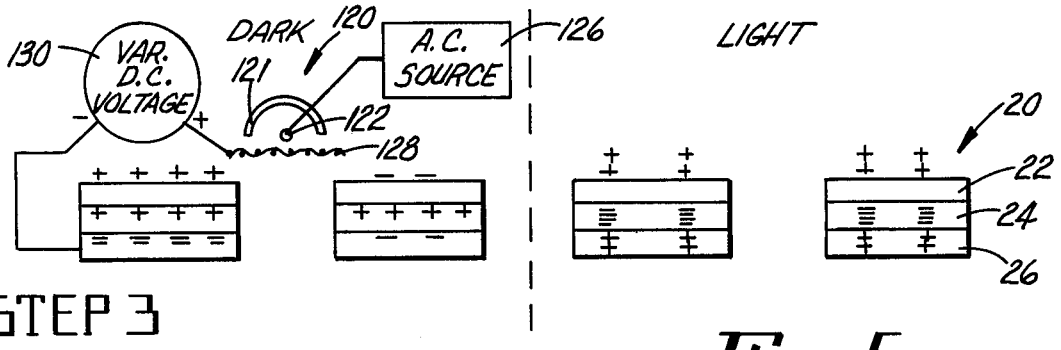
FIG. 5 is a schematic representation of alternative embodiment for carrying out the process.

In place of a balanced AC corona in step 3, there may be used an electrode assembly 120 such as shown in FIG. 5. The fine wire 122 is disposed in a grounded conductive shield 124 and connected to an AC source 126. In the path of the charges emitted from the wire 122 is a wire grid 128 connected to a variable voltage source 130. In the figure it is connected to the positive terminal applying a positive DC potential to the grid 128. The potential applied to modulator can be programmed by presetting the source 130 to alter the voltage in each of the zones so that they occur at different positions along the curve in FIG. 4.

In the circumstance that the insulator has been applied a negatively poled blanket electrostatic charge in step one, at the conclusion of the positive AC charge in the second step, there will be positive charges trapped in the dark areas of the photoconductive layer and positive charges on the insulating layer, while in the light zones a reversal to a positive charge occurs in the insulating surface and a balance of negative charges at the interface with the photoconductor.

The voltage level in the dark zones is much higher than the voltage in the light zones. Applying the constant voltage after illumination of +40 volts, for example, in the dark zone and a 0 voltage in the light zone, the relative optical density is 1.84 units.

Taking the corresponding values of % transmission from the curve, it is seen that in the blocking zone the % transmission is about 0.4% and in the funneling zone the transmission is about 28%. Images from the modulator provide excellent contrast.

In a similar fashion the voltage setting may be programmed so that during processing step No. 3, the voltage can let all surfaces be brought to a zero potential with respect to ground and the zones would be at −20 in the dark and +20 in the light. From the curve this yields a modulator having 4.5% transmission in the blocking zone and 55% transmission in the funneling zone. The charges funnel throught at a very fast rate but there is some slight amount of transmission in the blocking zones.

The novel process described hereinabove provides a wide range of imaging options. What is intended to be covered by the description is defined in the following claims.

What is claimed is:

1. The method of producing a charge distribution system ona modulator structure formed by placing a photoconductive layer between a conductive screen and a top transparent insulating layer, comprising the steps of:

applying an electrostatic DC charge of a first polarity to said top layer simultaneous with the application of a blanket exposure to electromagnetic radiation;

exposing said modulator to a pattern of light and shadow directed against said top layer and simultaneously applying a second DC charge oppositely poled to said first polarity to produce dark and light exposed zones on said modulator;

sweeping the surface of said top layer with AC charges under conditions in which said modulator is protected from radiation exposure;

flood irradiation of the top layer with electromagnetic radiation; whereby said charge distribution system is comprised of potential gradients between the conductive layer and said insulating layer in said dark and light zones respectively as represented by oppositely poled voltages on said top layer.

2. The method as claimed in claim 1 wherein said modulator is disposed in an electrode system comprising a emission electrode and a collecting electrode wherein charged particles emitted from said emission electrode are direction against said conductive layer and said collecting electrode is juxtaposed said top layer.

3. The method as claimed in claim 1 wherein the voltages on said top layer are of equal value.

4. The method as claimed in claim 1 wherein said photoconductive layer is comprised of a photoconductive medium having bichargeable properties.

5. The method as claimed in claim 4 wherein said photoconductive layer is comprised of an organic photoconductive component.

6. The method as claimed in claim 1 wherein said charged particles are gas ions.

7. The method as claimed in claim 2 wherein said charged particles are colored toner particles.

8. The method of making a reproduction of a graphic original by collecting charged particles on a dielectric medium through the use of a modulator structure formed by placing a photoconductive layer between a conductive screen and a top transparent insulating layer, comprising the steps of:

applying a electrostatic DC charge of a first polarity to said top layer simultaneous with the application of a blanket exposure to electromagnetic radiation exposing said modulator to a pattern of light and shadow directed against said top layer and simultaneously applying a second DC charge oppositely poled to said first polarity to produce dark and light exposed zones on said modulator;

sweeping the surface of said top layer with AC charges under conditions in which said modulator is protected from radiation exposure;

flood irradiation of the top layer with electromagnetic radiation;

whereby there is established zones on said modulator adapted to selectively block and transmit charged particles;

directing said charged particles from a particle emission source against the conductive layer of said modulator; and collecting those particles transmitted by said moudlator to said dielectric medium and causing the attraction of the remaining particles on the modulator in the blocked zones.

9. The method as claimed in claim 8 wherein said modulator is disposed in a plane parallel to said charged particle emission source and there is provided a collecting electrode adjacent the insulating layer on which is retained said dielectric medium.

10. The method as claimed in claim 8 wherein said graphic original is positive reading and a positive reproduction is produced from said graphic original.

11. The method as claimed in claim 8 wherein said emission electrode is connected to a DC high voltage source directing charged particles having the same polarity as said charge having a first polarity.

12. The method as claimed in claim 8 wherein the polarity of the charged particles from said emission electrode is opposite in polarity to said charge having a first polarity.

13. The method as claimed in claim 8 wherein said photoconductive layer is comprised of a photoconductive medium bichargeable properties.

14. The method as claimed in claim 8 wherein said photoconductive layer is comprised of an organic photoconductive component.

15. The method of producing a charge distribution system on a modulator structure formed by placing a photoconductive layer between a conductive screen and a top transparent insulating layer, comprising the steps of:

applying a electrostatic DC charge of a first polarity to said top layer simultaneous with the application of a blanket exposure to electromagnetic radiation;

exposing said modulator to a pattern of light and shadow directed against said top layer simultaneously applying a second DC charge oppositely poled to said charge of a first polarity to produce dark and light exposed zones on said modulator;

adjusting the voltage level in each of the zones to a different level by applying a fixed voltage from a biased AC source under conditions in which said modulatoris protected from radiation exposure;

applying a DC charge having a polarity opposite to said charge of a first polarity;

flood irradiation of said top layer with electromagnetic radiation;

whereby said charge distribution system is comprised of a potential gradient between the conductive layer and the insulating layer in the light exposed zones and no potential gradient between the conductive layer and the insulating layer in the dark zones.

16. The method as claimed in claim 15 wherein said modulator is disposed in an electrode system comprising an emission electrode and a collecting electrode wherein charged particles having the opposite polarity as said charge of a first polarity.

17. The method of making a reproduction of a graphic original by collecting charged particles on a dielectric medium through the use of a modulator structure formed by placing a photoconductive layer between a conductive screen and a top transparent insulating layer, comprising the steps of:

applying an electrostatic DC charge of a first polarity to said top layer simultaneous with the application of a blanket exposure to electromagnetic radiation;

exposing said modulator to a pattern of light and shadow directed against said top layer and simultaneously applying a second DC charge oppositely poled to said first polarity of produce dark and light exposed zones on said modulator;

modifying the voltages on the surface of the transparent insulating layer to a predetermined level by sweeping the surface with AC charges emitted from a controlled voltage electrode source;

flood irradiation of the top layer with electromagnetic radiation;

whereby there is established zones on said modulator adapted to selectively block and transmit charged particles;

directing said charged particles from a particle emission source against the conductive layer of said modulator; and collecting those particles transmitted by said modulator to said dielectric medium and causing the attraction of the remaining particles on the modulator in the blocked zones.

* * * * *